US006325070B1

(12) United States Patent
Tyroler et al.

(10) Patent No.: US 6,325,070 B1
(45) Date of Patent: Dec. 4, 2001

(54) BRUSH FOR HOLDING AT LEAST ONE OF A FLUID DISPENSING DEVICE AND OTHER ITEMS THEREIN

(76) Inventors: Dan Tyroler; Liat Tyroler, both of 37 Baker Hill Rd., Great Neck, NY (US) 11023

( * ) Notice: Subject to any disclaimer, the term of this patent is extended or adjusted under 35 U.S.C. 154(b) by 0 days.

(21) Appl. No.: 09/721,782

(22) Filed: Nov. 24, 2000

(51) Int. Cl.[7] ..... A45D 24/22; A45D 24/18

(52) U.S. Cl. ..... 132/112; 132/147; 132/140

(58) Field of Search ..... 132/112, 140, 132/147, 148, 150, 311, 313; 15/106; 401/123, 125; D4/108, 116, 138

(56) References Cited

U.S. PATENT DOCUMENTS

| | | | | |
|---|---|---|---|---|
| D. 148,382 | * | 1/1948 | Oriolo et al. | 132/147 |
| D. 279,648 | * | 7/1985 | Fini | D4/116 |
| 1,339,745 | * | 5/1920 | Dunaway | 132/313 |
| 2,299,296 | * | 10/1942 | Battle | 132/112 |
| 2,815,032 | * | 12/1957 | Rosenfeld | 132/148 |
| 3,102,544 | * | 9/1963 | Keegan et al. | 132/147 |
| 3,406,694 | * | 10/1968 | Odence | 132/313 |
| 3,544,226 | | 12/1970 | Kellis | 401/28 |
| 3,636,963 | * | 1/1972 | Olson | 132/112 |
| 3,868,188 | | 2/1975 | Yelardi | 401/190 |
| 3,960,160 | * | 6/1976 | Hogan | 132/112 |
| 4,289,153 | * | 9/1981 | Paccione | 132/313 |
| 4,557,619 | | 12/1985 | DeVincentis | 401/190 |
| 4,690,279 | | 9/1987 | Hochberg | 206/531 |
| 4,938,621 | | 7/1990 | Pyrozyk | 401/289 |
| 5,012,831 | * | 5/1991 | Canela | 132/313 |
| 5,320,125 | * | 6/1994 | Barnhart | 132/313 |
| 5,608,940 | * | 3/1997 | Panyon, Jr. | 132/308 |
| 5,746,531 | | 5/1998 | Izhak | 401/139 |
| 5,865,195 | * | 2/1999 | Carter | 132/308 |
| 5,927,290 | | 7/1999 | Thiruppathi | 132/116 |
| 5,967,152 | * | 10/1999 | Rimkus | 132/308 |

* cited by examiner

*Primary Examiner*—Todd E. Manahan
(74) *Attorney, Agent, or Firm*—Richard L. Miller, P. E.

(57) ABSTRACT

A brush for holding at least one of a fluid dispensing device and other items therein that includes a handle, a head, and bristles. The handle contains a chamber for holding either the fluid dispensing device or the other items therein, and the head contains a chamber. The chamber in the handle is separated from the chamber in the head by a floor. The floor is solid when the chamber in the handle holds the other items. The floor is not solid when the chamber in the handle holds the fluid dispensing device and the chamber in the head holds the other items.

17 Claims, 2 Drawing Sheets

FIG.1
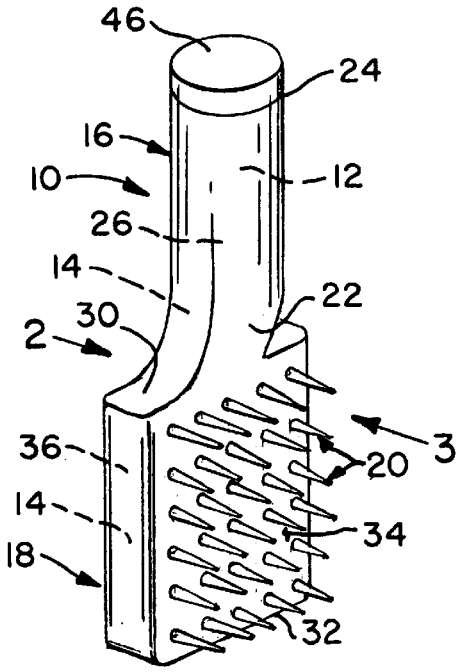
FIG.2
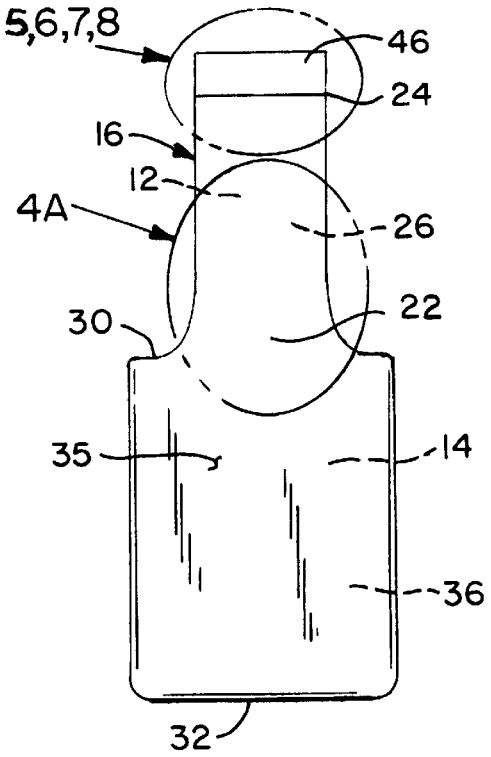
FIG.3
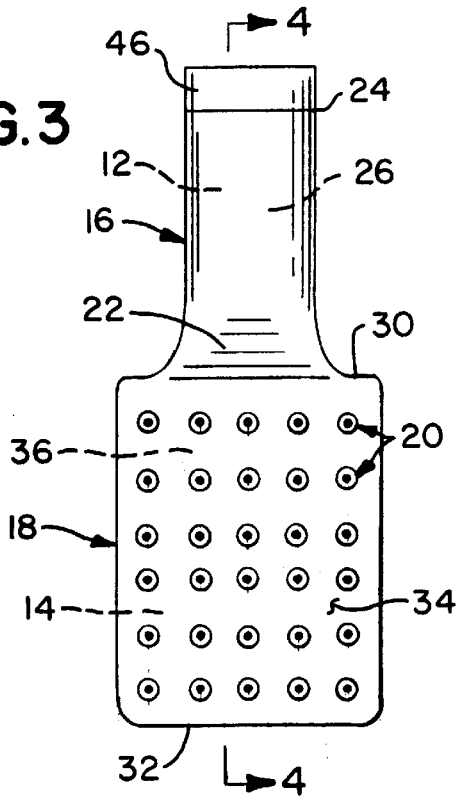
FIG.5
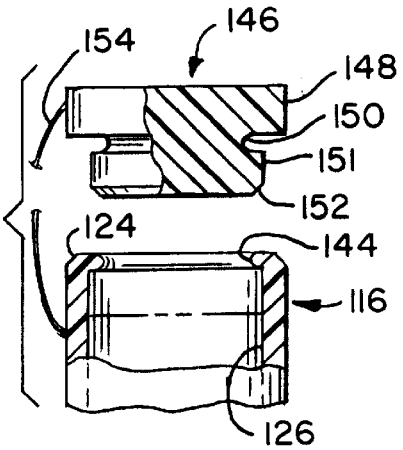
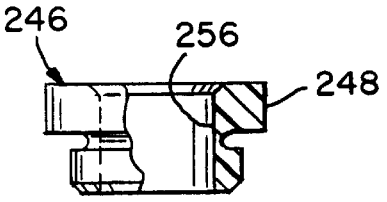
FIG.6

BRUSH FOR HOLDING AT LEAST ONE OF A FLUID DISPENSING DEVICE AND OTHER ITEMS THEREIN

BACKGROUND OF THE INVENTION

1. Field of the Invention

The present invention relates to a brush. More particularly, the present invention relates to a brush for holding at least one of a fluid dispensing device and other items therein.

2. Description of the Prior Art

Numerous innovations for dispensing hair brushes have been provided in the prior art that will be described. Even though these innovations may be suitable for the specific individual purposes to which they address, however, they differ from the present invention.

A first example, U.S. Pat. No. 3,444,226 to Kellis teaches a combination brush and bottle particularly adapted for utilization with materials such as hair shampoo which may be contained within the bottle and employed with the brush. A single unit comprising a bottle formed with a neck comprising a handle and a side comprising a brush, and preferably formed of light-weight, inexpensive plastic is provided hereby. Additionally, the invention provides for dispensing of the bottle contents while the invention is being employed as a brush through simple finger movement of a plate covered aperture.

A second example, U.S. Pat. No. 3,868,188 to Velardi teacher a brush including a brush head and a container from which a viscount substance is dispensed through passages in the brush head directly to the region of the bristles. The flow of the substance to the bristles is manually controlled and the brush head forms an extension of the container which functions as a handle. The container can have a knob for advancing a follower to dispense the substance in response to rotation of the knob. The container can also be of the pressurized type where dispensing the substance is controlled by manipulating a valve. The pressurized container has flexible wall section which permits locating the valve actuator within the pressurized part of the container so there is no danger of leakage at the connection between the brush head and the container. The brush and container can be used as a self-dispensing toothbrush.

A third example, U.S. Pat. No. 4,557,619 to DeVincentis teaches a hairbrush and aerosol spray assembly which enables efficient use of both the brush and the hair spray with one hand, while also enabling easy removal and replacement of the spray can. The brush includes a hollow generally cylindrical core with bristles extending radially outwardly therefrom. The core is attached to a base which in turn is detachably mounted to the aerosol spray can. A nozzle assembly including a plurality of nozzles in communication with one another is centrally and removably disposed within the cylindrical core and in communication with the nozzle of the aerosol spray can. The spray can be activated by a trigger lever disposed adjacent to the base of the brush or by an extension of the nozzle assembly which protrudes beyond the cylindrical core of the brush.

A fourth example, U.S. Pat. No. 4,690,279 to Hochberg teaches a package for oral contraceptives that has the outward appearance of a hair brush. A first compartment serves as a pill storage compartment; it retains a three week supply of pills of the type that are individually packaged under a flexible bubble and collectively mounted on a frangible support surface. The floor of the first compartment is apertured and each aperture is pill-sized and positioned in registration with a pill under a bubble. A closure member such as a hinged lid masks the presence of the pill-storage compartment, but when the lid is open and a bubble is pressed against, the frangible support surface for the pill breaks and allows the pill to fall into a second compartment with an imperforate bottom The second compartment is enclosed on three sides but open on a fourth so that a pill driven through its frangible support surface may be retrieved from such second compartment by tilting the brush.

A fifth example, U.S. Pat. No. 4,938,621 to Pyrozyk teaches a hair brush and mousse dispensing device that comprises a body portion having a top end and a bottom end. The body portion includes a mechanism for connecting the device to a pressurized mousse dispensing cylinder, the mechanism for connecting being adjacent the bottom end. The top end of the body portion has a styling brush including a plurality of bristles or teeth spaced therearound. The device includes a mechanism for dispensing the mousse from the device which is disposed between a dispensing tip of the pressurized mousse dispensing cylinder and a dispensing aperture in the body portion. The device further includes a mechanism for providing access to the dispensing tip of the pressurized mousse dispensing cylinder.

A sixth example, U.S. Pat. No. 5,746,531 to Pyrozyk teaches a hairbrush incorporated with a container that dispenses sprays, liquids, gels or other dispensable materials. The core of the hairbrush and the base of the container are joined end to end. The container forms the handle of the hairbrush. The top of the container has a closure cap, a cap with snap open lid or a spray nozzle to dispense the contents of the container.

A seventh example, U.S. Pat. No. 5,927,290 to Thiruppathi teaches a liquid dispensing hair brush that includes a body having a chamber therein. The hair brush includes a liquid container in the chamber. A trigger is also contained within the chamber. The trigger may be depressed such that it drives the liquid container relative to the body. A pump is disposed in the container that dispenses liquid from the container through a spray nozzle when the container is driven by the trigger. The pump and container are disposed in the head portion of the brush such that the pump stroke may be relatively short. The container may be removable and replaceable or refillable.

It is apparent that numerous innovations for dispensing hair brushes have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a brush for holding at least one of a fluid dispensing device and other items therein that avoids the disadvantages of the prior art.

Another object of the present invention is to provide a brush for holding at least one of a fluid dispensing device and other items therein that is simple and inexpensive to manufacture.

Still Another object of the present invention is to provide a brush for holding at least one of a fluid dispensing device and other items therein that is simple to use.

Briefly stated, still yet another object of the present invention is to provide a brush for holding at least one of a fluid dispensing device and other items therein that includes a handle, a head, and bristles. The handle contains a chamber for holding either the fluid dispensing device or the other items therein, and the head contains a chamber. The chamber in the handle is separated from the chamber in the head by a floor. The floor is solid when the chamber in the handle holds the other items. The floor is not solid when the chamber in the handle holds the fluid dispensing device and the chamber in the head holds the other items. The handle further has a cap. In a first embodiment, the cap is resilient and has an external portion, an intermediate portion, an internal portion, and a length of lanyard that prevents loss of the cap when removed from the handle. In a second embodiment of the cap, the cap of the first embodiment further has a throughbore that extends axially therethrough for insertion of the fluid dispensing device into the chamber in the handle without having to remove the cap and/or permitting activating the fluid dispensing device. In a third embodiment of the cap, the cap contains internal threads and the handle has external threads that selectively engage the internal threads in the cap. In a fourth embodiment of the cap, the cap of the third embodiment further has a throughbore that extends axially therethrough for the same purpose as in the second embodiment.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows:

FIG. 1 is a diagrammatic perspective view of the present invention;

FIG. 2 is a diagrammatic rear elevational view taken generally in the direction of arrow 2 in FIG. 1;

FIG. 3 is a diagrammatic front elevational view taken generally in the direction of arrow 3 in FIG. 1;

FIG. 5 is an enlarged diagrammatic elevational view, in partial section, of the area generally enclosed by the dotted curve identified by arrow 5 in FIG. 2 of a first embodiment of the cap of the present invention;

FIG. 6 is an enlarged diagrammatic elevational view, in partial section, of the area generally enclosed by the dotted curve identified by arrow 6 in FIG. 2 of a second embodiment of the cap of the present invention;

OF REFERENCE NUMERALS UTILIZED IN THE DRAWINGS

Figure 4:
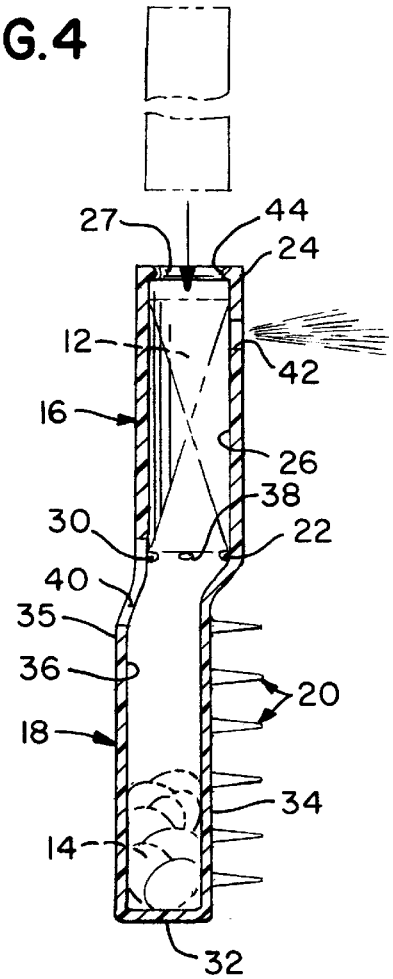
FIG. 4 is a diagrammatic cross sectional view taken on line 4—4 in FIG. 3.

10 brush of present invention for holding at least one of fluid dispensing device 12 and other items 14 therein
12 fluid dispensing device
14 other items
16 handle
18 head
20 bristles
22 proximal end of handle 16
24 distal end of handle 16
26 chamber contained in handle 16 for replaceably holding one of fluid dispensing device 12 and other items 14 therein
27 throughbore in distal end 24 of handle 16
30 proximal end of head 18
32 distal end of head 18
34 front surface of head 18
35 rear surface of head 18
36 chamber in head 16
38 floor
40 throughbore in rear surface 35 of head 18 for facilitating removal of fluid dispensing device 12 by receiving thumb to push fluid dispensing device 12 out through throughbore 27 in distal end 24 of handle 16
42 bore in handle 16 for allowing exit of fluid from fluid dispensing device 12
44 convex ring defining throughbore 27 in distal end 24 of handle 16 for preventing unintentional removal of fluid dispensing device 12, but is resilient for allowing fluid dispensing device 12 to be intentionally removed when pushed out therethrough
46 cap of handle 16

First Embodiment

116 handle
124 distal end of handle 116
126 chamber in handle 116
144 convex ring of handle 116
146 cap
148 external portion of cap 146
150 intermediate portion of cap 146
152 internal portion of cap 146
154 length of lanyard

Second Embodiment

246 cap
256 throughbore in cap 246 for insertion of fluid dispensing device 12 into chamber 126 in handle 116 without having to remove cap 246

Third Embodiment

316 handle
324 distal end of handle 316
346 cap
358 internal threads contained in cap 346
360 external threads on distal end 324 of handle 316

Fourth Embodiment

446 cap
456 throughbore in cap 446 for insertion of fluid dispensing device 12 into chamber 126 in handle 116 without having to remove cap 446

DESCRIPTION OF THE PREFERRED EMBODIMENT

Referring now to the figures, in which like numerals indicate like parts, and particularly to FIG. 1, the brush of the present invention is shown generally at 10 for holding at least one of fluid dispensing device 12 and other items 14 therein.

The overall configuration of the brush 10 can best be seen in FIGS. 1–4A, and as such, will be discussed with reference thereto.

The brush 10 comprises a handle 16, a head 18 that extends offsetingly from the handle 16, and bristles 20 that extend from the head 18.

The handle 16 is slender, elongated, cylindrically-shaped, and has a length, a proximal end 22, and a distal end 24.

The handle 16 is hollow, and as a result thereof, contains chamber 26 that extends the length for replaceably holding one of the fluid dispensing device 12 and the other items 14 therein, such as pills, coins, lipstick, scissors, or the like, and has a width The distal end 24 of the handle 16 has a throughbore 27 that extends axially therethrough and communicates with the chamber 26 in the handle 16.

The head 18 is typically illustrated as a rectangular-parallelepiped-shaped, and has a proximal end 30 that flares outwardly from, and is coincident with, the proximal end 22 of the handle 16, a distal end 32, a front surface 34, and a rear surface 35, but it is to be further understood that an infinite variety of shape be functional and is not limited to the shape illustrated.

The head 18 optionally may be hollow. When head 18 is hollow, as a result thereof it contains a chamber 36.

The bristles 20 extend outwardly from the front surface 34 of the head 18.

The chamber 26 in the handle 16 is separated from the chamber 36 in the head 18 by a floor 38 that is disposed across the proximal end 22 of the handle 16.

Figure 4A:
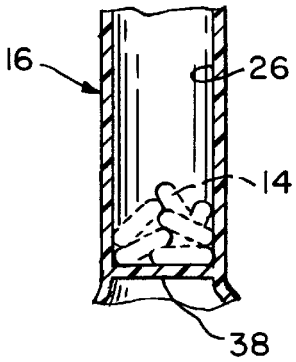
FIG. 4A is an enlarged diagrammatic cross sectional view of the area generally enclosed by the dotted curve identified by arrow 4A in FIG. 2 of an alternate embodiment of the handle of the present invention.

The floor 38 is solid when the chamber 26 in the handle 16 holds the other items 14 (see FIG. 4A).

The floor 38 is not solid when the chamber 26 in the handle 16 holds the optional fluid dispensing device 12 and the chamber 36 in the head 18 holds the other items 14 so as to allow the chamber 26 in the handle 16 to communicate with the chamber 36 in the head 18 for allowing removal of the other items 14 from the head 18 by removing the fluid dispensing device 12 from the handle 16 through the throughbore 27 in the distal end 24 of the handle 16 and turning the brush 10 over so as to allow the other items 14 in the head 18 to pass through the floor 38, through the handle 16, and out through the throughbore 27 in the distal end 24 of the handle 16.

The rear surface 35 of the head 18 has a throughbore 40 that is disposed just below, and communicates with, the floor 38 for facilitating removal of the fluid dispensing device 12 by receiving a thumb to push the fluid dispensing device 12 out through the throughbore 27 in the distal end 24 of the handle 16.

The handle 16 has a bore 42 that is disposed just below the distal end 24 thereof, and opposes the throughbore 48 in the rear surface 35 of the head 18 for allowing exit of fluid from the fluid dispensing device 12.

The throughbore 27 in the distal end 24 of the handle 16 is defined by a convex ring 44 for preventing unintentional removal of the fluid dispensing device 12, but is resilient for allowing the fluid dispensing device 12 to be intentionally removed when pushed out therethrough, and has a depth and a width.

The handle 16 further has a cap 46 that selectively closes the distal end 24 thereof.

The specific configuration of a first embodiment of the cap 146 can best be seen in FIG. 5, and as such, will be discussed with reference thereto.

The cap 146 is resilient and has an external portion 148 that is disk-shaped, has a width equal to the width of the handle 116, and selectively abuts against the distal end 124 of the handle 116.

The cap 146 further has an intermediate portion 150 that is disk-shaped, depends coaxially from, is integrally formed with, and is narrower than, the external portion 148 thereof, and has a perimeter 151 that is a concave ring, a depth equal to the depth of, and a width equal to the width of, the convex ring 144 of the handle 116 so as to be resiliently and selectively captured therein.

The cap 146 further has an internal portion 152 that is disk-shaped, depends coaxially from, is integrally formed with, and is wider than, the intermediate portion 150 thereof, is narrower than the external portion 148 thereof, and has a width equal to the width of, and selectively engages in, the chamber 126 in the handle 116.

The internal portion 152 of the cap 146 is tapered to facilitate insertion through the convex ring 144 of the handle 116.

The cap 146 further has a length of lanyard 154 that extends from the external portion 148 thereof to the distal end 124 of the handle 116 and prevents loss of the cap 146 when removed from the handle 116.

The specific configuration of a second embodiment of the cap 246 can best be seen in FIG. 6, and as such, will be discussed with reference thereto.

The cap 246 is similar to the cap 146, except:

1. The lanyard 154 is missing.
2. The cap 246 has a throughbore 256 that extends axially therethrough for insertion of the fluid dispensing device 12 into the chamber 126 in the handle 116 without having to remove the cap 246 and/or for activating the fluid dispensing device.
3. The throughbore 256 in the cap 246 is flared in the external portion 248 thereof for facilitating insertion of the fluid dispensing device 12 into the cap 246.

Figure 7:
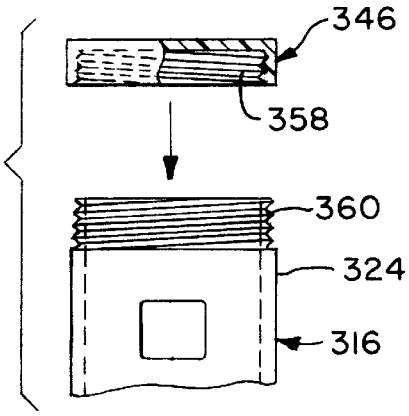
FIG. 7 is an enlarged diagrammatic elevational view, in partial section, of the area generally enclosed by the dotted curve identified by arrow 7 in FIG. 2 of a third embodiment of the cap of the present invention.

The specific configuration of a third embodiment of the cap 346 can best be seen in FIG. 7, and as such, will be discussed with reference thereto.

The cap 346 is disk-shaped and contains internal threads 358 therearound.

The distal end 324 of the handle 316 has external threads 360 therearound that selectively engage the internal threads 358 in the cap 346.

Figure 8:
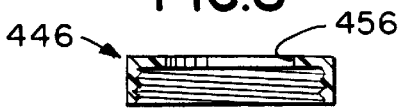
FIG. 8 is an enlarged diagrammatic elevational view, in partial section, of the area generally enclosed by the dotted curve identified by arrow 8 in FIG. 2 of a fourth embodiment of the cap of the present invention.

The specific configuration of a fourth embodiment of the cap 446 can best be seen in FIG. 8, and as such, will be discussed with reference thereto.

The cap 446 is similar to the cap 346, except that the cap 446 has a throughbore 456 that extends axially therethrough for insertion of the fluid dispensing device 12 into the chamber 126 in the handle 116 without having to remove the cap 446 and/or for activating the fluid dispensing device.

It is to be understood that a cap is optional and while illustrated in many embodiments is not necessary as illustrated in FIG. 4.

It will be understood that each of the elements described above, or two or more together, may also find a useful application in other types of constructions differing from the types described above.

While the invention has been illustrated and described as embodied in a brush for holding at least one of a fluid dispensing device and other items therein, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A brush for holding at least one of a fluid dispensing device and other items therein, said brush comprising:

a) a handle;

b) a head extending from said handle; and c) bristles extending from said head, wherein said handle is slender, elongated, cylindrically-shaped, and has:

i) a length;

ii) a proximal end; and iii) a distal end, wherein said handle is hollow, and as a result thereof, contains a chamber that extends said length threreof for replaceably holding one of the fluid dispensing device and the other items therein, and has a width, wherein said distal end of said handle has a throughbore that extends axially therethrough and communicates with said chamber in said handle, wherein said head has:

A) a proximal end that flares outwardly from, and is coincident with, said proximal end of said handle; and B) a distal end, wherein said chamber in said handle is separated from said chamber in said head by a floor that is disposed across said proximal end of said handle, wherein said floor is not solid when said chamber in said handle holds the fluid dispensing device and said chamber in said head holds the other items so as to allow said chamber in said handle to communicate with said chamber in said head for allowing removal of the other items from said head by removing the fluid dispensing device from said handle through said throughbore in said distal end of said handle and turning said brush over so as to allow the other items in said head to pass through said floor, through in said handle, and out through said throughbore in said distal end of said handle.

2. The brush as defined in claim 1, wherein said head is hollow, and as a result thereof, contains a chamber.

3. The brush as defined in claim 1, wherein said bristles extend outwardly from said head.

4. The brush as defined in claim 1, wherein said floor is solid when said chamber in said handle holds the other items.

5. The brush as defined in claim 1, wherein said handle further has a cap that selectively closes said distal end thereof.

6. The brush as defined in claim 5, wherein said cap is disk-shaped and contains internal threads therearound.

7. The brush as defined in claim 6, wherein said distal end of said handle has external threads therearound that selectively engage said internal threads in said cap.

8. The brush as defined in claim 7, wherein said cap has a throughbore that extends axially therethrough for insertion of the fluid dispensing device into said chamber in said handle without having to remove said cap.

9. A brush for holding at least one of a fluid dispensing device and other items therein, said brush comprising:

a) a handle;

b) a head extending from said handle; and c) bristles extending from said head, wherein said handle is slender, elongated, cylindrically-shaped, and has:

i) a length;

ii) a proximal end; and iii) a distal end, wherein said handle is hollow, and as a result thereof, contains a chamber that extends said length thereof for replaceably holding one of the fluid dispensing device and the other items therein, and has a width, wherein said distal end of said handle has a throughbore that extends axially therethrough and communicates with said chamber in said handle, wherein a surface of said head has a throughbore that is disposed just below, and communicates with, said floor for facilitating removal of the fluid dispensing device by receiving a thumb to push the fluid dispensing device out through said throughbore in said distal end of said handle.

10. The brush as defined in claim 9, wherein said handle has a bore that is disposed just below said distal end thereof, and opposes said throughbore in said surface of said head for allowing exit of fluid from the fluid dispensing device.

11. The brush as defined in claim 9, wherein said head is hollow, and as a result thereof, contains a chamber.

12. The brush as defined in claim 9, wherein said bristles extend outwardly from said head.

13. The brush as defined in claim 9, wherein said floor is solid when said chamber in said handle holds the other items.

14. A brush for holding at least one of a fluid dispensing device and other items therein, said brush comprising:

a) handle;

b) ahead extending form said handle; and c) bristles extending form said head, wherein said handle is slender, elongated, cylindrically-shaped, and has:

i) a length;

ii) a proximal end; and iii) a distal end, wherein said handle is hollow, and as a result thereof, contains a chamber that extends said length thereof for replaceably holding one of the fluid dispensing device and the other items therein, and has a width, wherein said distal end of said handle has a throughbore that extends axially therethrough and communicates with said chamber in said handle, wherein said throughbore in said distal end of said handle is defined by a convex ring for preventing unintentional removal of the fluid dispensing device, but is resilient for allowing the fluid dispensing device to be intentionally removed when pushed out therethrough, and has a depth and a width, wherein said handle further has a cap that selectively closes said distal end thereof, wherein said cap is resilient and has an external portion that is disk-shaped, has a width equal to said width of said handle, and selectively abuts against said distal end of said handle, wherein said cap further has an intermediate portion that is disk-shaped, depends coaxially from, is integrally formed with, and is narrower than, said external portion thereof, and has a perimeter that is a concave ring, a depth equal to said depth of, and a width equal to said width of, said convex ring of said handle so as to be resiliently and selectively captured therein, wherein said cap further has an internal portion that is disk-shaped, depends coaxially from, is integrally formed with, and is wider than, said intermediate portion thereof, is narrower than said external portion thereof, and has a width equal to said width of, and selectively engages in, said chamber in said handle, wherein said cap further has a throughbore that extends axially therethrough for insertion of the fluid dispensing device into said chamber in said handle without having to remove said cap.

15. The brush as defined in claim 14, wherein said internal portion of said cap is tapered to facilitate insertion through said convex ring of said handle.

16. The brush as defined in claim 14, wherein said cap further has a length of lanyard that extends from said external portion thereof to said distal end of said handle and prevents loss of said cap when removed from said handle.

17. The brush as defined in claim 14, wherein said throughbore in said cap is flared in said external portion of said cap for facilitating insertion of the fluid dispensing device into said cap.

* * * * *